United States Patent [19]

Crumbliss

[11] Patent Number: 4,726,306

[45] Date of Patent: Feb. 23, 1988

[54] TUFTING MACHINE FOR OVERTUFTING

[75] Inventor: Robert T. Crumbliss, Chattanooga, Tenn.

[73] Assignee: Spencer Wright Industries, Inc., Dalton, Ga.

[21] Appl. No.: 6,227

[22] Filed: Jan. 23, 1987

[51] Int. Cl.[4] ..... D05C 15/14

[52] U.S. Cl. ..... 112/80.32

[58] Field of Search ..... 112/80.32

[56] References Cited

U.S. PATENT DOCUMENTS 3,091,199 5/1963 Ballard ..... 112/80.32

3,511,195 5/1970 Hasler et al. ..... 112/80.32

3,986,465 10/1976 Smith et al. ..... 112/80.32

*Primary Examiner*—Ronald Feldbaum

*Attorney, Agent, or Firm*—Alan Ruderman

[57] ABSTRACT

A controlled needle tufting machine for overtufting a secondary yarn into a base material having primary yarn therein includes feed rollers and take-off rollers for feeding the base material. The feed rollers and the take-off rollers each include a picker roll which engages the back-stitch surface of the backing material, i.e., the surface opposite to that from which the pile fabric extends, and not the face or pile extending surface.

2 Claims, 2 Drawing Figures

TUFTING MACHINE FOR OVERTUFTING

BACKGROUND OF THE INVENTION

This invention relates to tufting machines and more particularly to the feeding of base material to a controlled needle tufting machine for performing overtufting operations.

Controlled needle tufting machines are known which operate to skip stitch in accordance with a program for forming tufted designs in a backing fabric. Basically these machines render selective needles or groups of needles inoperative while the remainder of the needles are operative to pierce the backing fabric upon each stroke of the needle bar. Examples of this type of machine are illustrated in U.S. Pat. Nos. 3,115,856; 3,259,088 and 3,881,432.

Overtufting is a process wherein a fabric previously formed with tufted pile fabric is then tufted to insert additional pile, such additional pile being stitched at predetermined locations in the base material and primary or base pile. Overtufting with yarn of different colors than the primary pile provides desirable and appealing patterning effects in the fabric, especially carpeting.

In the production of carpeting in this manner the base material with the primary pile is fed over the needle plate of the tufting machine with the primary pile projecting downwardly toward the loopers or hooks which cooperate with the needles carrying the overtuft or secondary yarn.

Conventionally, the feeding of the base material through a tufting machine occurs through a plurality of feed rollers and take-up rollers. When base material is fed to the tufting instrumentalities, e.g., the needles and hooks, the base material is guided and fed between a pair of rollers. One of the rollers, known as a picker roll because it has a multiplicity of picks, or spikes or pins, extending from the surface thereof, engages and grasps the base material. As illustrated in U.S. Pat. No. 3,986,465, it is known in the prior art to utilize a picker roll between a pair of smooth surface rollers at the take-up portion of the feed system downstream of the tufting instrumentalities, but in regard to the rolls feeding material toward the tufting instrumentalities the picker roll is disposed beneath the base material, i.e., the lower surface of the base material is guided over and engages the picker roll. This has been the case whether the tufting machine is conventional or is an overtuft controlled needle machine. Although such feeding creates no significant problems when overtufting a low density fabric, it is now been found that when high density (or fine gauge) fabrics are to be overtufted, the picker rolls tend to pull the primary pile from the base material with the result that the carpet produced has snags and loose yarn ends.

SUMMARY OF THE INVENTION

Accordingly, the present invention provides feed roller apparatus for feeding a primary tufted fabric to a tufting machine for forming an overtufted pile fabric, whereby the primary or base pile is not pulled from the fabric by the rollers.

It is another object of the present invention to provide apparatus for feeding base material including a primary pile to a tufting machine for overtufting yarn, said apparatus including a roller with picks for engaging the surface of the base material opposite to the surface from which the primary pile tufts extend.

It is a further object of the present invention to provide in a tufting machine for tufting secondary yarn pile into a backing material having primary yarn pile extending from a surface thereof, feed rollers for feeding the base material including the primary yarn pile to the tufting instrumentalities, at least one of said rollers being a picker roll having picks extending from the surface thereof, and said rollers being arranged such that the picker roll engages the surface of the base material remote from the surface from which the primary yarn pile extends.

Accordingly, the present invention provides in a controlled needle tufting machine for overtufting a secondary yarn into a base material having primary yarn extending therefrom, a base material feed system including pile fabric feed rollers for feeding the base material to the tufting instrumentalities and pile fabric take-off rollers for feeding the overtufted material from the tufting instrumentalities, the picker rolls being arranged in both the feed section and the take-off section such that the picker rolls engage the back-stitch surface of the fabric and not the face or pile extending surface of the fabric.

More specifically the present invention provides a plurality of feed rolls upstream or before the tufting instrumentalities in the feed roller section of a controlled needle tufting machine for feeding the base material having the primary pile extending from a surface thereof, one of the feed rolls being a picker roll having a multiplicity of picks extending therefrom, said picker roll being disposed for engaging the surface opposite to the surface from which the primary pile extends. Preferably the picker roll is disposed intermediate the base material supply and a smooth surface feed roll, and the base material is fed beneath the picker roll and over the smooth surface roll. Another smooth roll may be provided between the picker roll and the supply so that the base material may be trained and fed over the two smooth surface rolls and beneath the picker roll on its path from the supply to the tufting instrumentalities.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
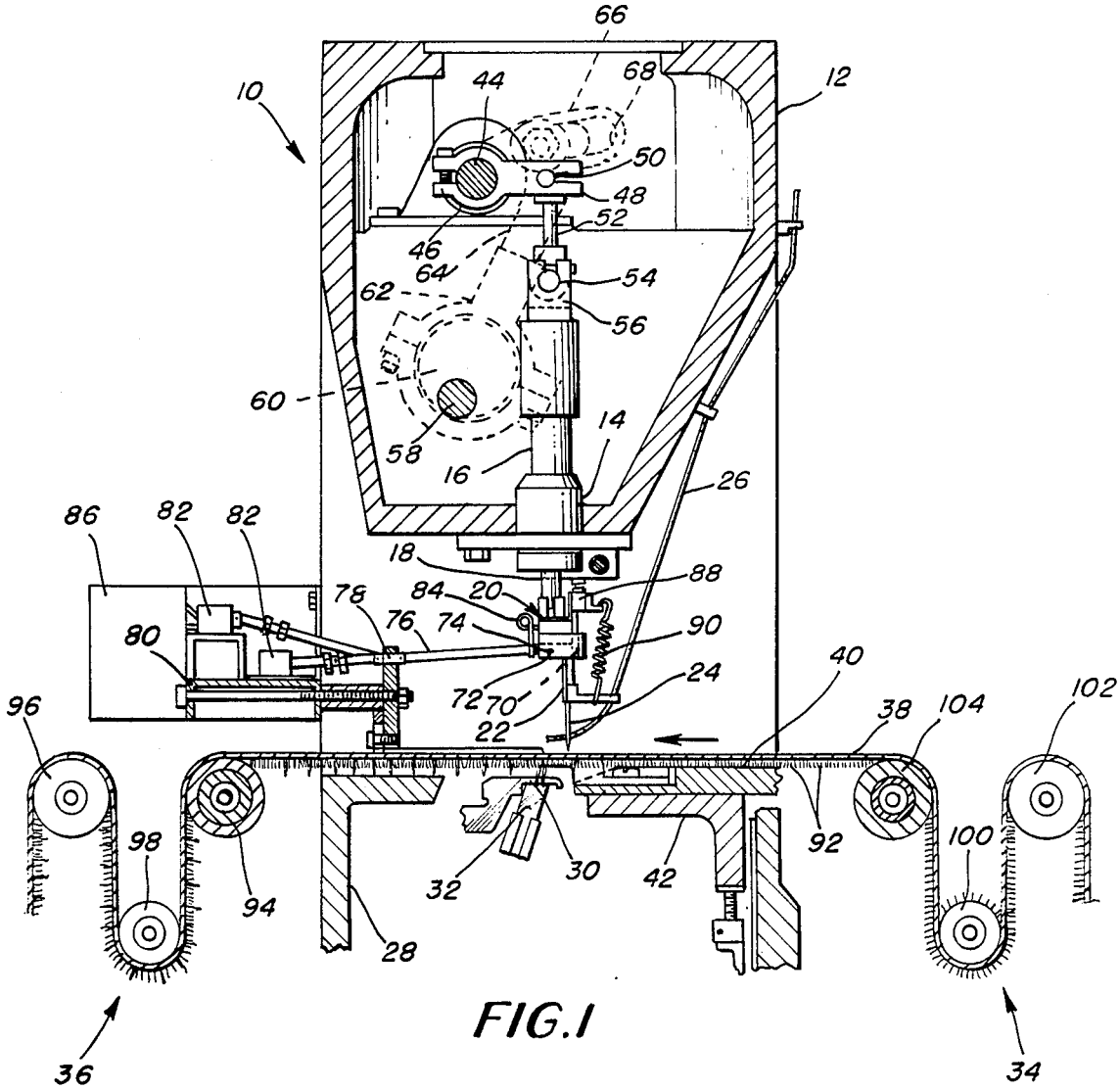
FIG. 1 is a vertical cross sectional view taken substantially through a tufting machine incorporating the features of the present invention.

Referring to the drawings, and more particularly to FIG. 1, the pertinent portions of a tufting machine 10 required for a description of the present invention is disclosed. The machine comprises a head 12 within which is secured a plurality of collars 14, only one of which is illustrated, for supporting respective sleeves 16. Journally disposed for reciprocation within each sleeve 16 is a push rod 18. The lower end of the push rods 18 support a needle bar 20, extending transversely of the tufting machine. Slidably supported for selective coupling to the needle bar are a plurality of needle carriers 22, each of which preferably supports a single needle 24. Yarn 26 may be fed to the needles 24 in any conventional manner.

Below the head in a bed 28 a plurality of loopers or hooks 30 are conventionally mounted for cooperation with a respective needle to seize loops of yarn therefrom, which loops may be cut by knives 32 coacting with the hooks to form cut pile. Front feed rollers 34 and rear take-up rollers 36 act to feed the backing material 38 across a needle plate generally indicated at 40 and needle plate fingers 41 for presentation of the backing material to the needles. Preferably the fingers 41 are constructed with a step as described in Slattery copending application Ser. No. 912,316 assigned to the common assignee hereof, and the needle plate is mounted on an adjustable front bed plate 42.

The push rods 18 may be driven by adjustable drive means similar to that disclosed in U.S. Pat. No. 2,977,905, the drive generally comprising a main shaft 44 rotatably mounted in the head 12 of the machine. Each push rod includes a rocker arm 46 clamped to the main shaft and extending radially therefrom to provide a crank arm 48 conventionally connected by a wrist pin 50 to a connecting link 52. Another wrist pin 54 may connect the lower end of the link 52 to an enlarged upper end 56 of the push rod 18. The rocking motion of the shaft 44 thus effects a reciprocating motion to the push rods and hence to the needle bar 20.

Rocking motion may be conventionally supplied to the main shaft 44 through means including a camshaft 58 parallel to the shaft 44 and driven at one end of the machine by conventional means. A circular eccentric cam 60 is secured on the shaft 58 preferably adjacent each end and a connecting rod 62 is journally mounted on the cam. The upper end 64 of the connecting rod is adjustably connected to a drive lever 66 secured at one end to the main shaft 44, the drive lever 66 having an arcuate slot within which the upper end 64 of the connecting rod is connected. The path of the slot 68 has a center of curvature coinciding with the geometric center of the cam 60 when the cam is at bottom dead center so that the needle stroke may be adjusted without changing the bottom position of the needle stroke. Repositioning of the connection between the upper end 64 of the connecting rod 62 in the slot 68 changes the amplitude of oscillation of the lever 66 and effects a change in amplitude in rocking of the shaft 44.

The tufting machine illustrated is a controlled needle machine in which selective needle carriers 22 may be coupled to the reciprocating needle bar 20. Coupling of a needle carrier 22 to the needle bar thereby results in reciprocation of the respective needle 24 for insertion of a loop of yarn through the backing material for seizure of the loop by the hook 30. To this end the needle bar 20 comprises a block having vertical bores 70 for slidably receiving the respective needle carriers 22, and a plurality of substantially horizontal bores 72 for slidably receiving a latch pin 74 for each needle carrier having a prong at the end thereof. Each latch pin is pivotably connected to one end of a connecting rod 76 operatively connected through a link 78 constrained for slidable movement. A mounting bracket 80 may be secured to the frame of the machine 10 for supporting a plurality of solenoids or the like 82, each being operatively connected to a respective link 78 so as to insert or withdraw the respective latch pin 74 to engage or disengage the corresponding needle carrier 22 from the reciprocating needle bar 20. When the solenoid is deactivated a spring 84 urges the prong at the end of the latch pin into driving relationship with the needle bar. Activation and deactivation of the respective solenoids is controlled by a pattern control mechanism 86 of any conventional type. An adjustable needle carrier stop bar 88 is supported above the needle carriers to aid in limiting the upward stroke of the reciprocating needle carriers, one end of a respective spring 90 being fastened to the stop bar and the other end being fastened to a respective needle carrier to urge it upwardly against the stop bar when the respective solenoid is activated to disengage the respective needle carrier from the needle bar.

In the method of overtufting, the backing material 38 has a tufted primary pile fabric 92 formed therein prior to beihg fed by the roller means, 36 to the machine 10 and the yarn 26 is tufted by the needles 24 selectively to form a secondary pile in the fabric, the secondary pile forming a pattern therein as determined by the pattern control 86. Since tufts extend from the lower face of the backing material 38 the primary pile tufts 92 are disposed on and fed over the needle plate 40.

Figure 2:
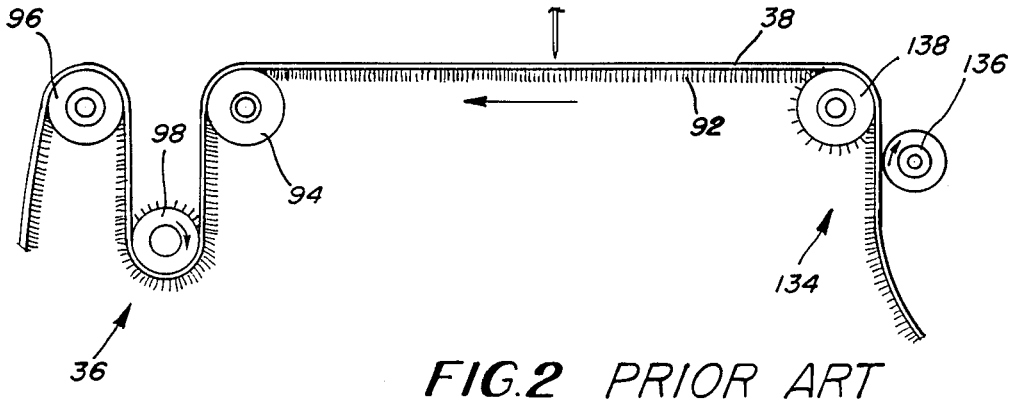
FIG.2 PRIOR ART
FIG. 2 is a view illustrating the fabric feed and take-off rollers as arranged in the prior art.

The rear or take-up rollers 36 comprise first and second substantially smooth surface rolls 94, 96 over which the backing material 38 is trained in its path to a receiving station (not illustrated). A picker roll 98 is disposed intermediate the rolls 94 and 96 so as to grasp and pull the backing material, the backing being trained about the lower peripheral surface of the picker roll 98. As illustrated in FIG. 2, the take-up rollers of the prior art have been constructed and arranged in this manner. The front feed rollers 134 in the prior art, as illustrated in FIG. 2, generally have consisted of two rolls, a smooth roll 136 and a picker roll 138, the picker roll being downstream from the roll 136. The backing in the prior art has been fed from a supply (not illustrated) to the nip between the rolls 136,138, the backing being guided over the picker roll 138 by the roll 136. This construction and arrangement has been used for the known tufting machines, whether of the conventional type or a controlled needle type, and this has been conventional even when overtufting.

It has now been found that when overtufting high density fabric, i.e., backing material having a fine gauge primary pile tufted therein, the prior art feed roller system tends to pull out the primary yarn tufts from the backing. In accordance with the present invention the feed rollers 34 are constructed and arranged in a manner similar to the take-off rollers. Thus, an additional smooth surface roll is inserted into the system and the picker roll is disposed between the two smooth surface rolls. As illustrated in FIG. 1, the picker roll 100 of the feed roller system is disposed between a pair of smooth surface rolls 102, 104 and the backing is fed from the supply (not illustrated) over the first roll 102 with the primary pile fabric tufts 92 disposed over the surface thereof. The fabric is then fed beneath the picker roll 100 and over the second smooth surface roll 104 in its path to the needles. Preferably, the roll 100 has its rotational axis disposed at an elevation lower than the axes of the rolls 102, 104. Thus, the picks of the picker roll 100 do not engage the pile surface of the fabric, but engages the backing surface, i.e., the surface having the back stitches. The primary pile surface of the backing then is fed over the smooth surface roll 104 and the needle plate 40 so that the secondary yarn tufts can be overtufted into the primary fabric.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the application, what is claimed herein is:

1. In a controlled needle tufting machine including feed means for feeding a pile fabric comprising a backing material having tufts of primary yarn pile extending from a first surface thereof, said primary pile having a first height, and a plurality of stitch forming instrumentalities at a stitching station for forming tufts of secondary yarn pile selectively in said backing to provide an overtuft pile fabric, said feed means comprising a plurality of feed rollers for feeding said backing material including said primary yarn pile from a supply to said stitching and a plurality of take-up rollers for feeding said overtuft pile fabric from said stitching station to a receiving station, said take-up rollers and said feed rollers each comprising at least one picker roll having a multiplicity of picks extending from the periphery theeof disposed for frictionally engaging the surface of said backing material opposite from said first surface, each picker roll being disposed intermediate a pair of substantially smooth surface rolls, and said backing material is trained over said smooth surface rolls with said primary yarn pile in contact with peripheral portions of said smooth surface rolls of said feed rollers, and with said primary and secondary yarn pile in contact with peripheral portions of said smooth surface rolls of said take-up rollers, whereby neither primary yarn yarn pile nor secondary yarn pile is contacted by a picker roll.

2. In a tufting machine as recited in claim 1 wherein the axis of each picker roll is disposed at an elevation below the axes of the associated smooth surface rolls.

* * * * *